US006585225B1

(12) United States Patent
Lake

(10) Patent No.: US 6,585,225 B1
(45) Date of Patent: Jul. 1, 2003

(54) APPLIANCE SUPPORT BASE

(76) Inventor: Russell D. Lake, PMB 344 1400-3 Village Square Blvd, Tallahassee, FL (US) 32312

( * ) Notice: Subject to any disclaimer, the term of this patent is extended or adjusted under 35 U.S.C. 154(b) by 0 days.

(21) Appl. No.: 09/687,095

(22) Filed: Oct. 16, 2000

(51) Int. Cl.[7] ..... F16M 11/00; A47B 87/00

(52) U.S. Cl. ..... 248/678; 248/346.02; 248/346.3; 312/108; 206/320

(58) Field of Search ..... 248/188.2, 188.1, 248/346.02, 346.3, 346.4, 673, 676, 677, 678; 206/320; 312/108, 111, 351.5; 220/578, 1.5, 4.23, 4.34, 7

(56) References Cited

U.S. PATENT DOCUMENTS 3,327,882 A * 6/1967 Andrews ..... 206/387.1
3,424,365 A * 1/1969 Venturi ..... 220/6
3,985,258 A * 10/1976 Quigley et al. ..... 220/4.28
4,000,827 A * 1/1977 Emery ..... 220/4.28
4,079,531 A * 3/1978 Norris et al. ..... 211/58
4,120,551 A * 10/1978 Godtschalck ..... 220/691
4,132,311 A * 1/1979 Glinert ..... 206/387.1
4,243,197 A * 1/1981 Wright ..... 248/678
4,456,142 A * 6/1984 Burling ..... 220/4.28
4,492,153 A * 1/1985 Grabowski ..... 99/460
4,936,117 A * 6/1990 Kabeya ..... 68/3 R
5,310,146 A * 5/1994 Maguire ..... 248/188.2
5,711,444 A * 1/1998 Meacham et al. ..... 220/6
5,921,646 A * 7/1999 Hwang ..... 312/263
6,193,340 B1 * 2/2001 Schenker et al. ..... 312/265.5

FOREIGN PATENT DOCUMENTS

JP 5336970 * 5/1978
JP 5336971 * 5/1978

* cited by examiner

*Primary Examiner*—Leslie A. Braun
*Assistant Examiner*—Naschica S. Morrison
(74) *Attorney, Agent, or Firm*—John Wiley Horton

(57) ABSTRACT

This invention comprises a support base designed to elevate an appliance such as a washer, dryer, or refrigerator in order to provide more convenient access. The invention also optionally provides castors on the bottom of the support base so that the appliance may be easily moved, if the user desires such mobility.

2 Claims, 8 Drawing Sheets

APPLIANCE SUPPORT BASE

BACKGROUND—FIELD OF INVENTION

This invention relates to the field of appliances. More specifically, the invention comprises a base which can be used to raise the height of an appliance such as a washer, dryer, or refrigerator. The invention is comprised of simple molded components which can be joined without the need for separate fastening hardware.

BACKGROUND—DESCRIPTION OF PRIOR ART

Appliances such as laundry washing and drying machines now have standard dimensions. A typical size for such an appliance is 27 inches wide by 27 inches deep by 36 inches high. FIG. 1 shows a typical washer and dryer in a side-by-side installation. Washer 10 has washer door 14 in its upper surface. Dryer 12 has dryer door 16 in its front surface. The user may transfer laundry through washer door 14—which is located approximately 36 inches off the floor—without having to stoop. However, the user must often bend own considerably to transfer laundry through dryer door 16. This repetitive stooping while loading and unloading laundry can be a problem for older persons and injured persons. Accordingly, it is desirable to raise dryer 12 so that dryer door 16 is placed at a more convenient level.

It is also true that appliances must be moved in and out in order to clean around them and unclog the lint vent. Because the appliances are typically resting on rigid feet, this movement is difficult. It would therefore be advantageous to provide a device which would facilitate the movement of the appliances as well as raise them.

Rolling cabinets are well known in the prior art. One example is U.S. Pat. No. 5,205,629 to Simons (1993). He Simons device is a small cabinet with four castors. Its height is such that it can be placed beneath a desk or table when not in use. A similar device is disclosed in U.S. Pat. No. 5,921,646 to Hwang (1999). The Hwang device is a rolling cabinet which is particularly suited for use with TV and stereo equipment. Although useful, neither the Simons nor the Hwang device is sturdy enough to support a laundry drying machine (which can weigh upwards of 100 pounds).

A device which is particularly adapted to appliances is disclosed in U.S. Pat. No. 5,741,054 to Becker et.al. (1998). The Becker device is a molded structural foam base attached to the bottom of a portable dishwasher. It does allow the dishwasher to be easily moved about. However, it does not elevate the dishwasher above its normal position.

Another type of rolling appliance attachments disclosed in U.S. Pat. No. 4,758,057 to Spiegel (1988). This invention is a modification to the conventional frame of a dishwasher. Two wheels are added near the rear portion of the frame, so that when the front of the unit is lifted it can be rolled into place. While an effective solution, the Spiegel device cannot be applied to existing appliances without extensive modification. Also, like the Becker device, it does nothing to elevate the appliance.

The known devices for elevating and moving an appliance such as a washer, dryer, or refrigerator are therefore limited in that they:

1. Do not elevate the appliance;
2. Cannot be retroactively applied to existing appliances; and
3. Are not sturdy enough to support the weight of large appliances.

OBJECTS AND ADVANTAGES

Accordingly, several objects and advantages of the present invention are:

1. To provide an appliance support which can elevate an appliance so that it may be more conveniently used;
2. To provide an appliance support which is applicable to a wide range of existing appliances;
3. To provide an appliance support which is sturdy enough to support washers, dryers, and refrigerators; and
4. To provide an appliance support which may be molded in large quantities at a relatively low cost.

DRAWING FIGURES

Reference Numerals in Drawings

| | | | |
|---|---|---|---|
| 10 | washer | 12 | dryer |
| 14 | washer door | 16 | dryer door |
| 18 | support base | 20 | side wall |
| 22 | top surface | 24 | appliance recess |
| 26 | spacer beam recess | 28 | notch |
| 30 | locking lug | 32 | locking pin |
| 34 | lug recess | 36 | pin recess |
| 38 | spacer beam | 40 | notch lug |
| 42 | castor hole | 44 | castor |
| 46 | alternate side wall | 48 | drawer |
| 50 | outer surface | 52 | right surface |
| 54 | left surface | 56 | inner surface |
| 58 | hollow interior | 60 | upper beam surface |
| 62 | lower beam surface | 64 | bottom surface |
| 66 | drawer opening | 68 | lower reinforcement rib |

DESCRIPTION

Figure 1:
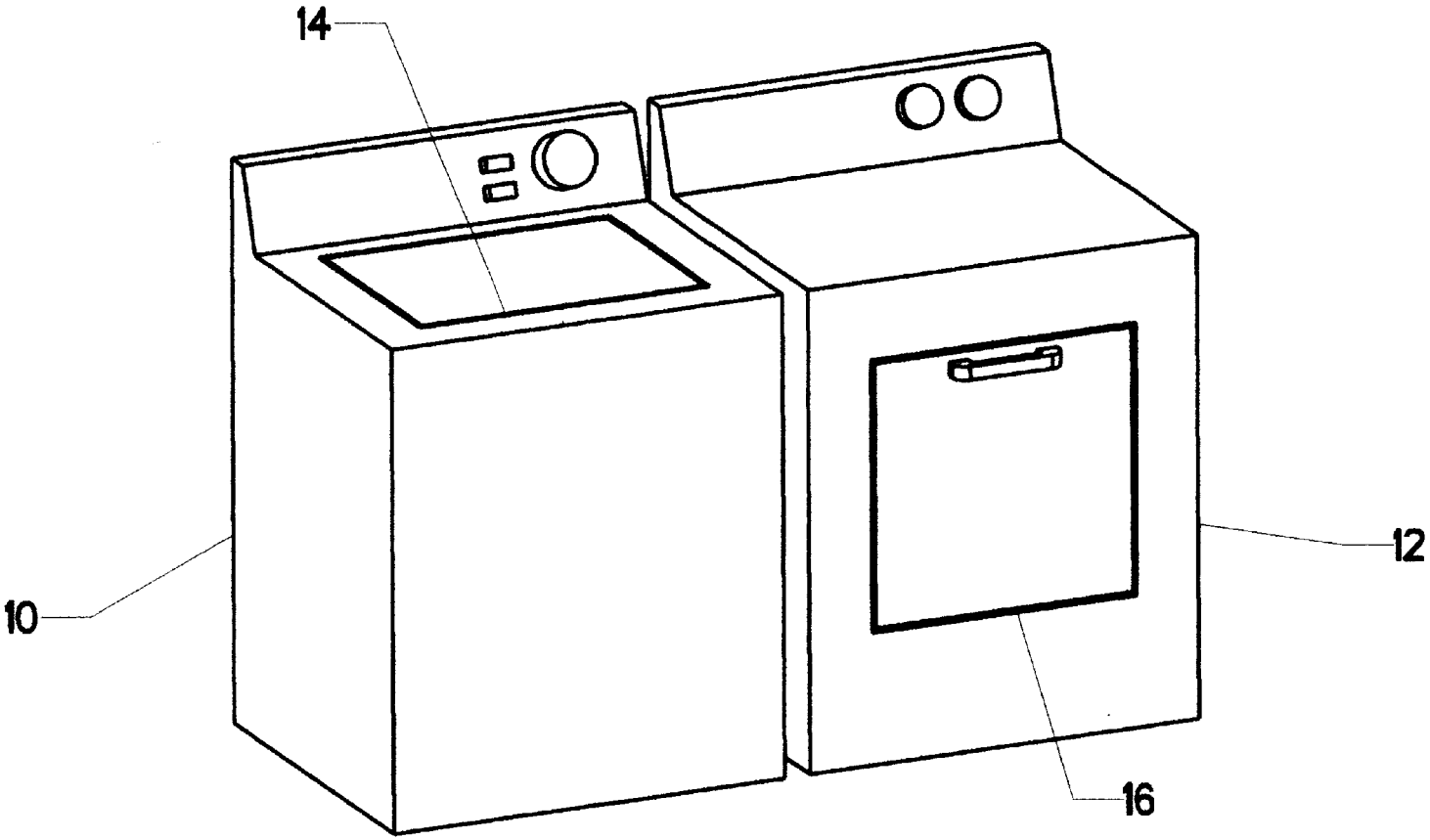
FIG. 1 is an isometric view, showing a conventional washer and dryer in a side-by-side installation.
Figure 2:
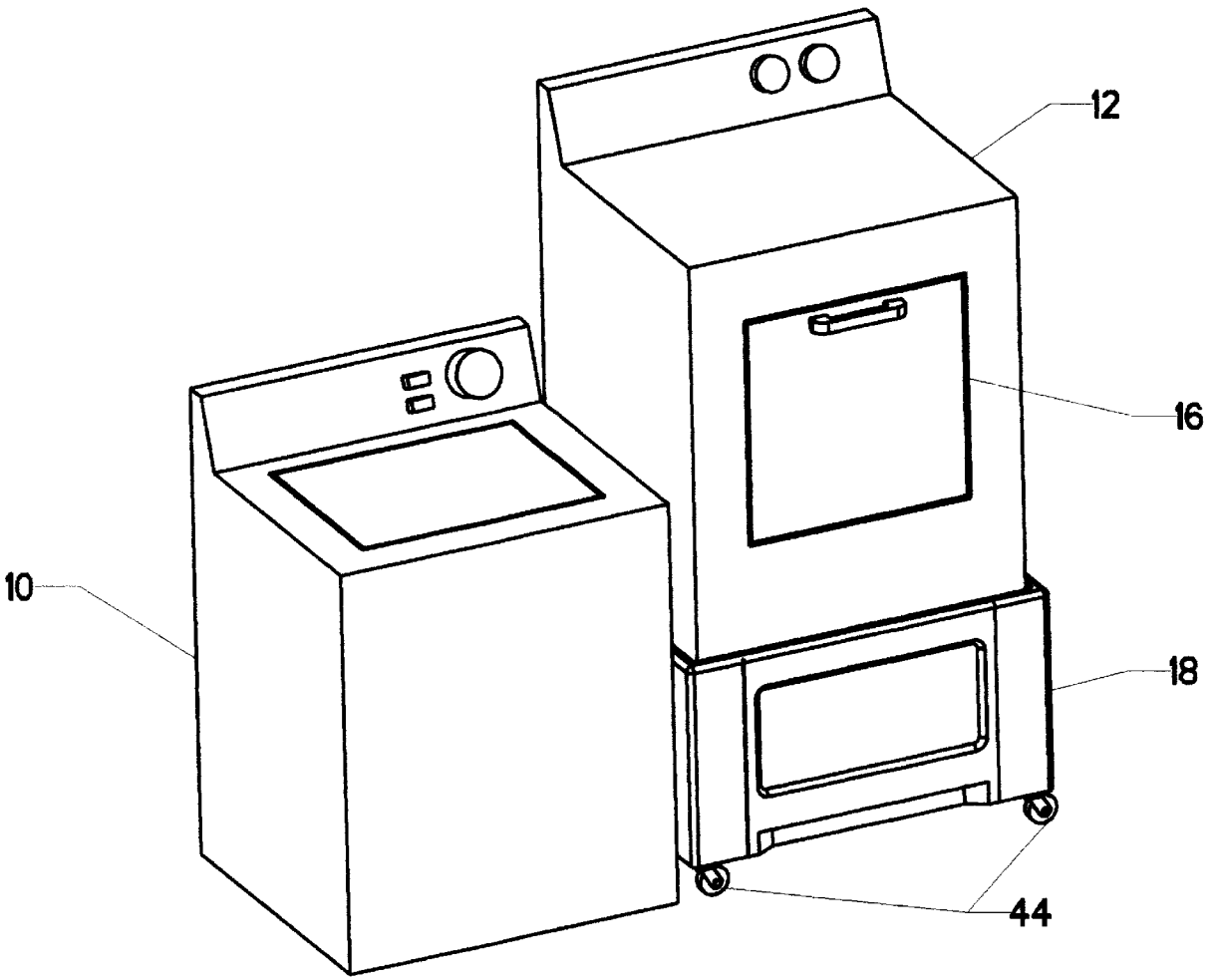
FIG. 2 is an isometric view, showing the proposed invention placed under an appliance.
Figure 3:
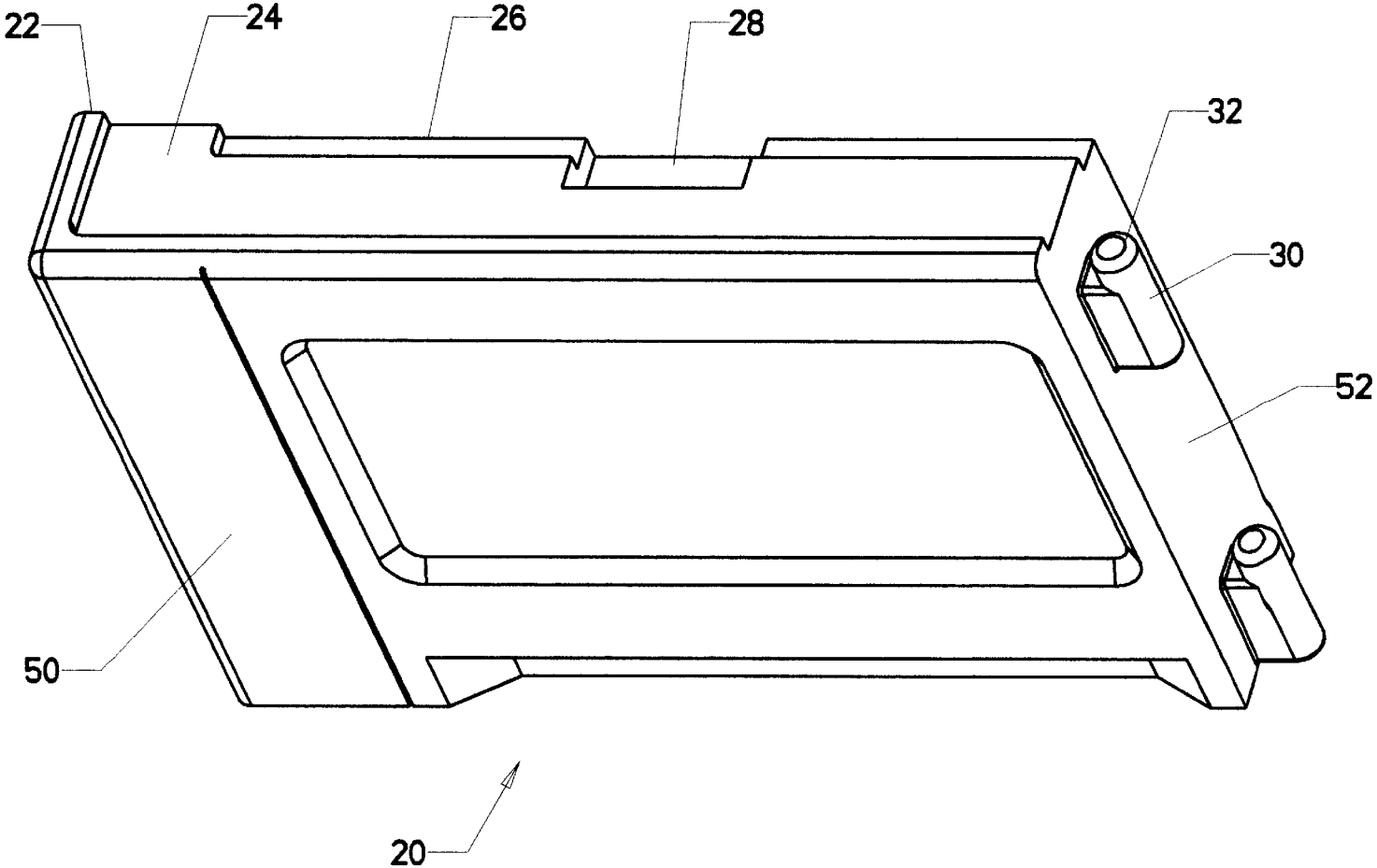
FIG. 3 is an isometric view showing one of the molded side walls that comprise the proposed invention.

FIG. 2 shows washer 10 and dryer 12 in a side-by-side installation. Support box 18 has been placed under dryer 12 to elevate it approximately 16 inches. Dryer door 16 has been consequently elevated and is therefore more easily accessible. Support box 18 also has castors 44 attached to its lower surface. These allow the user to easily roll dryer 12 out of its position to facilitate mopping and vacuuming. The reader should be aware that although support box 18 has been illustrated as raising dryer 12, it may also be used to raise washer 10, refrigerators, or various other appliances.

Figure 4:
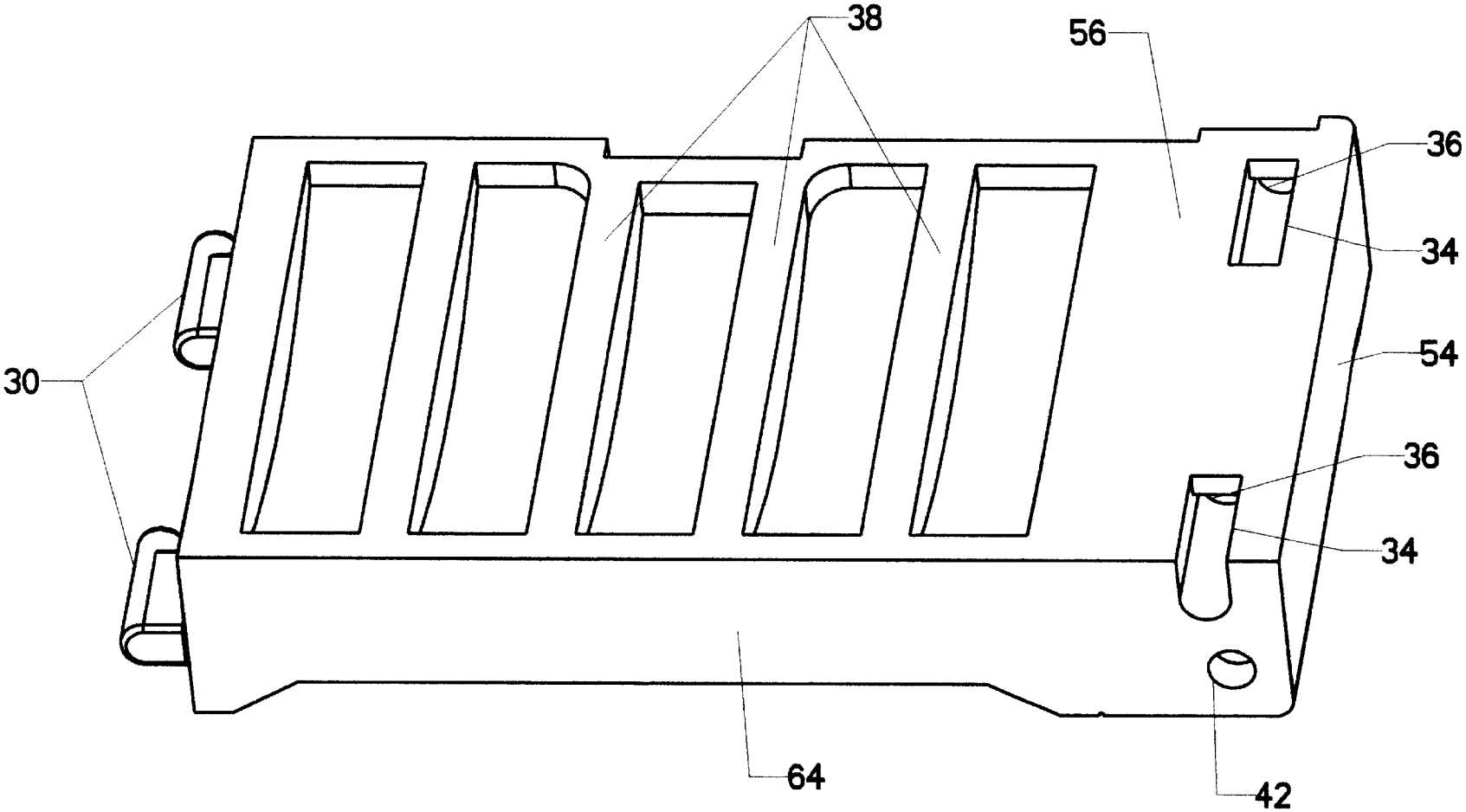
FIG. 4 is an isometric view, showing a different side of said molded side wall.
Figure 5:
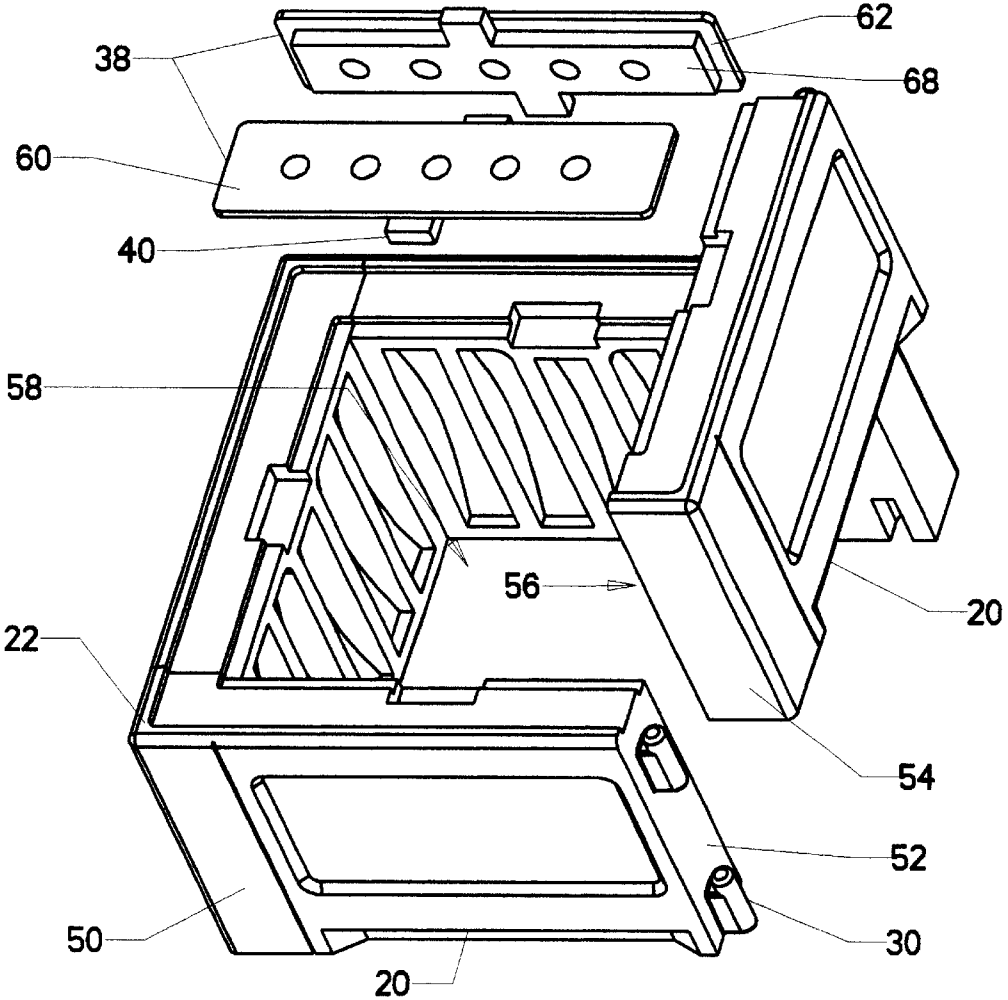
FIG. 5 is an isometric view showing how the molded side walls are joined to form a support base.

Turning now to FIG. 5, the details of support box 18 will be explained. Support box 18 is comprised of four side walls 20. In the typical embodiment all four side walls 20 are identical. Side wall 20 has outer surface 50, top surface 22, and right surface 52. Turning briefly to FIG. 4, the reader will note inner surface 56, left surface 54, and bottom surface 64.

Returning now to FIG. 5, the reader will observe that top surface 22 opens into appliance recess 24. It also contains notch 28. The function of these features will be disclosed subsequently. Right surface 52 has two locking lugs 30. Each locking lug 30 has a locking pin 32 protruding from its top. Tuning again to FIG. 4, the reader will observe that inner surface 56 open into two lug recesses 34. Each lug recess 34 also has a pin recess 36. Locking lugs 30 and lug recesses 34 are designed to interlock and thereby fasten together two adjacent side walls 20.

Inner surface 56 has a plurality of stiffening ribs 38, intended to stiffen side wall 20. Though a variety of rib designs could be employed, the one illustrated has proven to be particularly effective when side wall 20 is made as a hollow, thin-walled structure (such as in roto-molding). Bottom surface 64 has a single castor hole 42. Castor 44 is mounted therein, and is free to swivel about its mounting pin.

Turning now to FIG. 5, the assembly of support base 18 will be explained. A succession of four side walls 20 are locked together to form support base 18. A first side wall 20, which is lowest as shown in the view, has exposed right surface 52 and locking lugs 30. A second side wall 20 is shown prior to assembly (in the right hand portion of the view). Inner surface 56 of the second side wall 20 is mated to right surface 52 of the first side wall 20. Locking lugs 30 on the first side wall 20 engage lug recesses 34 on the second side wall 20. Once the second side wall 20 is pressed into place, left surface 54 of the second side wall 20 will be flush with outer surface 50 of the first side wall 20. Top surface 22 of the second side wall 20 will also be flush with top surface 22 of the first side wall 20.

Those skilled in the art will appreciate that four identical side walls 20 can be assembled as previously explained to form an interlocked support base 18 in a simple step-wise procedure. The last of the four side walls 20 to be assembled requires more manipulation in that both its end must be linked simultaneously. The result is a box structure having hollow interior 58. The appliance recesses 24 within the upper portion of each side wall 20 also join to define a large recessed square, which is sized to accommodate the base of most standard appliances.

However, some appliances may be too small to span hollow interior 58. This problem is typically encountered with small refrigerators, such as those found in hotel rooms and college dormitories. An appliance with a small footprint would be unable to rest on appliance recess 24 without falling into hollow interior 58. Accordingly, another component is needed to remedy this problem.

FIG. 5 shows this additional component—spacer beam 38. Spacer beam 38 is in the form of an elongated bar. It has upper beam surface 60 and lower beam surface 62. Lower reinforcing rib 68 is provided to stiffen spacer beam 38 when bending moments are applied.

Figure 6:
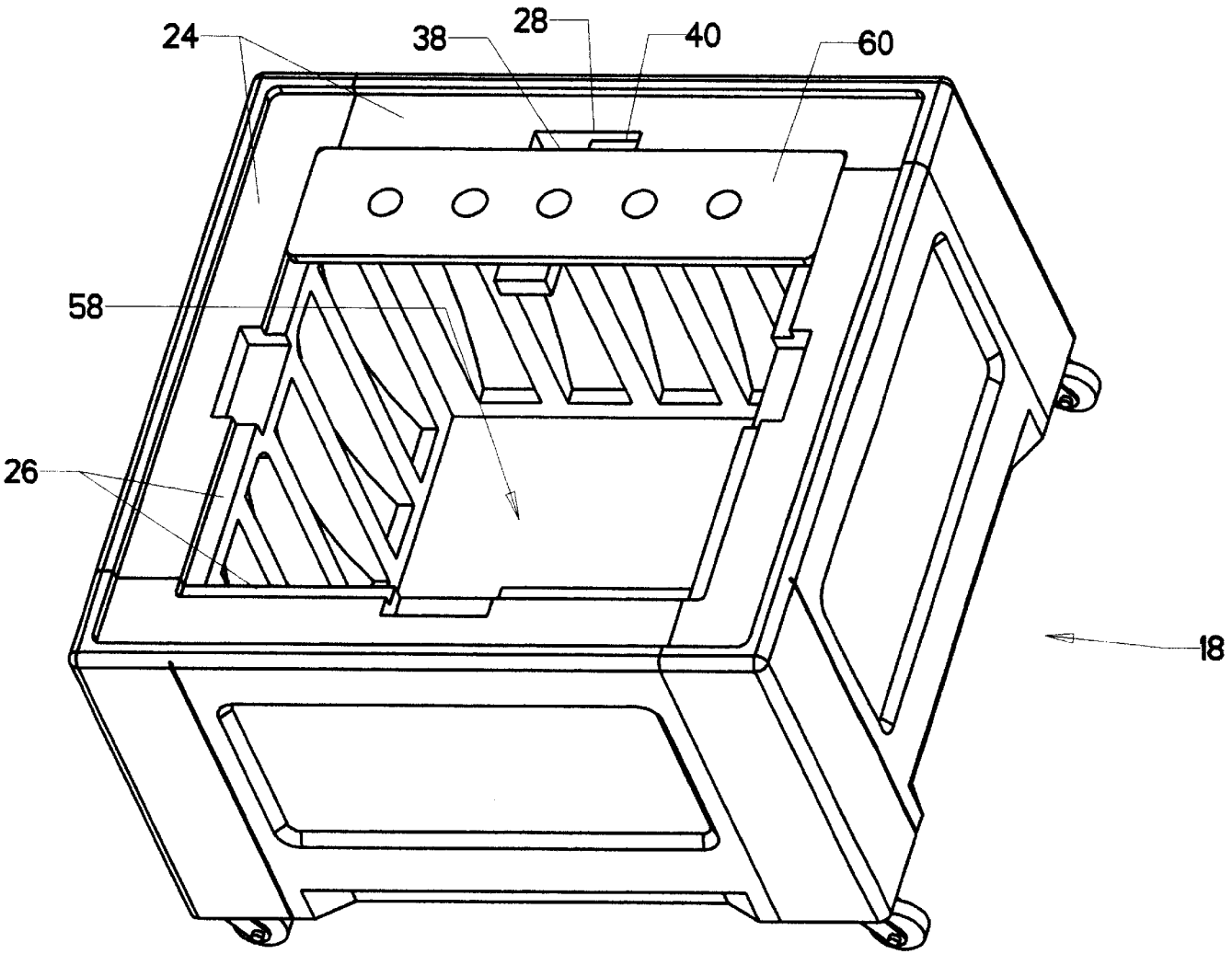
FIG. 6 is an isometric view, showing the completed base.

FIG. 6 illustrates spacer beam 38 in place over hollow interior 58. The length of spacer beam 38 is set to fit within the spacer beam recess 26 on two opposing side walls 20. Lower beam surface 62 mates to the surface designated as spacer beam recess 26 on the two opposing side walls 20. In this position, upper beam surface 60 is flush with appliance recess 24. Thus, spacer beam 38 has effectively covered a portion of hollow interior 58.

Notch lug 40 fits within notch 28 in the upper (as illustrated) side wall 20, thereby further restricting unwanted movement of spacer beam 38. Spacer beam 38 actually has two notch lugs 40 on opposite sides. They are offset to allow nesting of several spacer beams 38. Those skilled in the art will appreciate that the user can add three additional spacer beams 38 (in addition to the first one illustrated) in order to completely cover hollow interior 58. Thus, virtually any type of small appliance can be accommodated. Spacer beams 38 are made strong enough to support the weight of the appliance.

Figure 7:
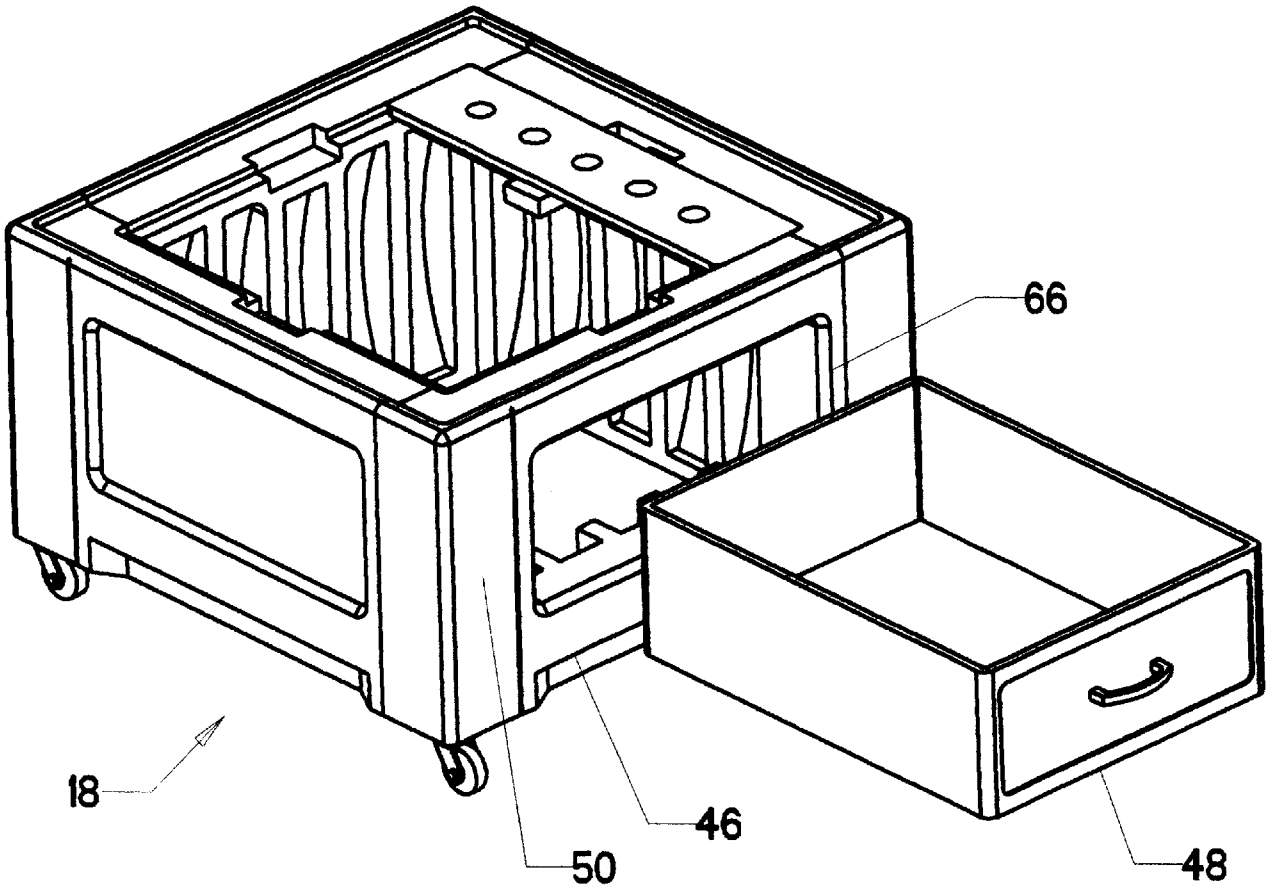
FIG. 7 is an isometric view, showing an alternate embodiment which incorporates a storage compartment.

With reference to FIGS. 2 and 6, the reader will observe that the base of dryer 12 fits within appliance recess 24. With respect to FIGS. 2 and 8, the reader will also observe that castors 44 allow dryer 12 to be easily rolled in and out of its normal position. FIG. 7 is also significant in that it contains alternate side wall 46. One of the previously illustrated side walls 20 has been replaced by alternate side wall 46. Alternate side wall 46 is identical to side wall 20 except that its outer surface 50 opens into drawer opening 66, which passes completely through side wall 46. Drawer 48 slidably fits within drawer opening 66. This modification allows the user to utilize the space within hollow interior 58. Drawer 48 can also be made as a pivoting hamper or other commonly known variation. This advantage makes the version illustrated in FIG. 7 the preferred embodiment.

Figure 8:
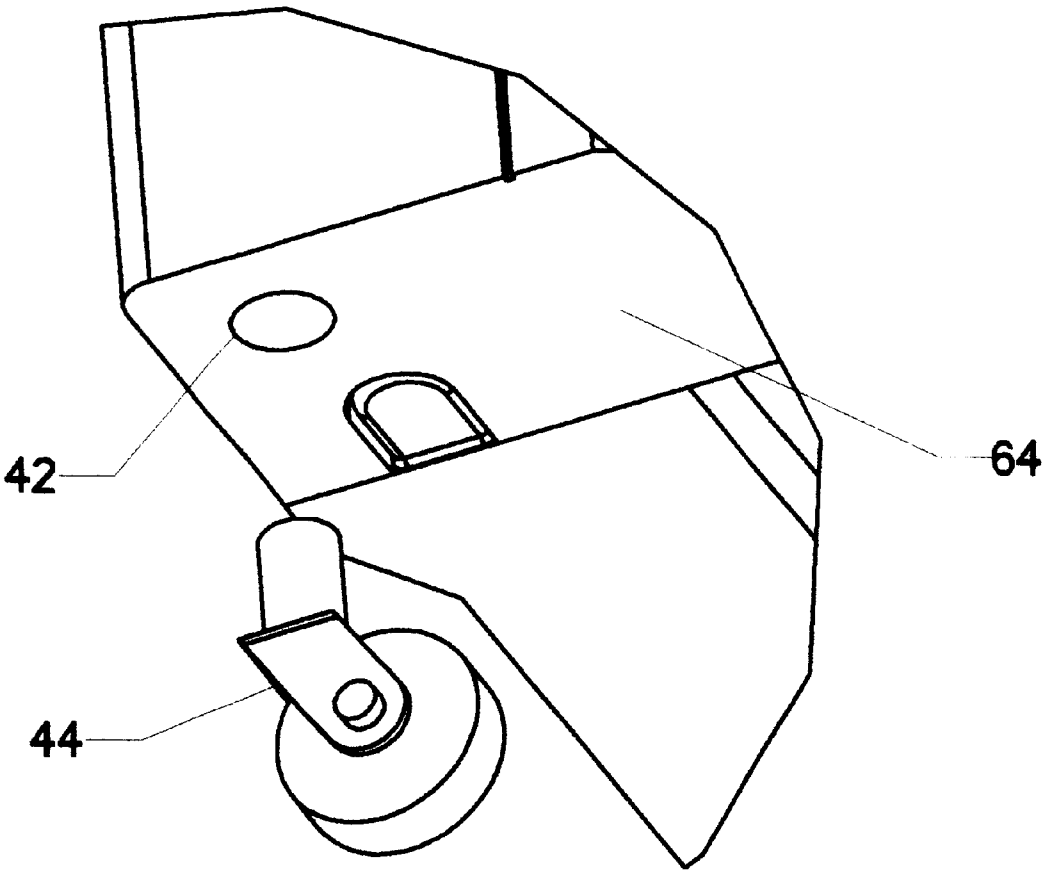
FIG. 8 is an isometric view, showing the installation of castors on the bottom of the base.

FIG. 8 shows an enlarged view of castor 44 being inserted in castor hole 42. Castors 44 are held in place by the weight of support base 18. However, they should be a fairly tight fit, so that they do not fall out when support base 18 is lifted off the floor. Alternatively, they can be retained by a spring clip or other conventional retaining device.

The reader should be aware that the user has the option to omit castors 44. The user may want the appliance to be unable to move around. If this is desired, omitting castors 44 results in the bottom of support base 18 resting directly on the floor. The rest of the device functions in exactly the same way.

The strength of the material used to construct side wall 20 and spacer beam 38 is significant, as the completed assembly must support substantial loads. A hollow, double-walled structure has been found to be particularly effective. Molding plastics—such as ABS—are sufficiently strong when used in the roto-molding process. Reaction-injection molding and structural foam molding can also be employed to create walls having enough thickness to meet the strength requirements. Any of these processes can produce a substantial quantity of side walls 20 at a reasonable cost.

SUMMARY, RAMIFICATIONS, AND SCOPE

Accordingly, the reader will appreciate that the proposed invention allows the elevation and easy movement of a variety of appliances such as washers, dryers, and refrigerators. The invention has further advantages in that:

1. It provides an appliance support which is applicable to a wide range of existing appliances;
2. It provides an appliance support which is sturdy enough to support washers, dryers, and refrigerators; and
3. It provides an appliance support which may be molded in large quantities at a relatively low cost.

Although the preceding description contains significant detail, it should not be construed as limiting the scope of the invention but rather as providing illustrations of the preferred embodiment of the invention. For example, many types of manufacturing processes beyond those discussed could be employed to make side wall 20 without altering the central objective of the invention. Thus, the scope of the invention should be fixed by the following claims, rather than by the examples given.

Having described my invention, I claim:

1. A device for elevating an appliance, comprising:

a. a first side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface;

b. a second side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said second side wall is mated to said right surface of said first side wall, and said left surface of said second side wall is flush with said outer surface of said first side wall, and said top surface of said second side wall is flush with said top surface of said first side wall, so that said at least one locking lug extending from said right surface of said first side wall rests within said at least one lug recess within said inner surface of said second side wall, thereby locking said second side wall to said first side wall;

c. a third side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said third side wall is mated to said right surface of said second side wall, and said left surface of said third side wall is flush with said outer surface of said second side wall, and said top surface of said third side wall is flush with said top surface of said second side wall, so that said at least one locking lug extending from said right surface of said second side wall rests within said at least one lug recess within said inner surface of said third side wall, thereby locking said third side wall to said second side wall;

d. a fourth side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said fourth side wall is mated to said right surface of said third side wall, and said left surface of said fourth side wall is flush with said outer surface of said third side wall, and said top surface of said fourth side wall is flush with said top surface of said third side wall, so that said at least one locking lug extending from said right surface of said third side wall rests within said at least one lug recess within said inner surface of said fourth side wall, thereby locking said fourth side wall to said third side wall, and wherein said at least one locking lug extending from said right surface of said fourth side wall rests within said at least one lug recess within said inner surface of said first side wall, thereby locking said fourth side wall to said first side wall, so that said first, second, third, and fourth side walls form a support base having a hollow interior, with said appliance recesses within said top surfaces of said first, second, third, and fourth side walls forming a recessed and planar supporting surface for said appliance;

e. wherein each of said at least one locking lugs has a locking pin extending therefrom;

f. wherein each of said at least one lug recesses opens into a pin recess, with said pin recess being positioned to receive said locking pin so that when said first side wall, said second side wall, said third side wall, and said fourth side wall are assembled, they are mechanically locked together by the containment of said locking pins within said pin recesses;

g. wherein said appliance recesses in said top surfaces of said first, second, third, and fourth side walls open into a first, second, third, and fourth spacer beam recess; and h. at least one spacer beam, being in the form of an elongated flat bar, and having a first end, a second end, an upper beam surface and a lower beam surface, wherein said lower beam surface proximate said first end is mated to said spacer beam recess in said first side wall, and wherein said lower beam surface proximate said second end is mated to said spacer beam recess in said third side wall, so that said spacer beam covers a portion of said hollow interior.

2. A device for elevating an appliance, comprising:

a. a first side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface;

b. a second side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said second side wall is mated to said right surface of said first side wall, and said left surface of said second side wall is flush with said outer surface of said first side wall, and said top surface of said second side wall is flush with said top surface of said first side wall, so that said at least one locking lug extending from said right surface of said first side wall rests within said at least one lug recess within said inner surface of said second side wall, thereby locking said second side wall to said first side wall;

c. a third side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said third side wall is mated to said right surface of said second side wall, and said left surface of said third side wall is flush with said outer surface of said second side wall, and said top surface of said third side wall is flush with said top surface of said second side wall, so that said at least one locking lug extending from said right surface of said second side wall rests within said at least one lug recess within said inner surface of said third side wall, thereby locking said third side wall to said second side wall;

d. a fourth side wall, having an outer surface, an inner surface, a top surface, a right surface, and a left surface, wherein said top surface has an appliance recess, wherein said right surface has at least one locking lug extending therefrom, and wherein said inner surface opens into at least one lug recess proximate said left surface, and being oriented so that said inner surface of said fourth side wall is mated to said right surface of said third side wall, and said left surface of said fourth side wall is flush with said outer surface of said third side wall, and said top surface of said fourth side wall is flush with said top surface of said third side wall, so that said at least one locking lug extending from said right surface of said third side wall rests within said at least one lug recess within said inner surface of said fourth side wall, thereby locking said fourth side wall to said third side wall, and wherein said at least one locking lug extending from said right surface of said fourth side wall rests within said at least one lug recess within said inner surface of said first side wall, thereby locking said fourth side wall to said first side wall, so that said first, second, third, and fourth side walls form a support base having a hollow interior, with said appliance recesses within said top surfaces of said first, second, third, and fourth side walls forming a recessed and planar supporting surface for said appliance; and e. at least one spacer beam, being in the form of an elongated flat bar, and having a first end, a second end, an upper beam surface and a lower beam surface, wherein said lower beam surface proximate said first end is mated to said spacer beam recess in said first side wall, and wherein said lower beam surface proximate said second end is mated to said spacer beam recess in said third side wall, so that said spacer beam covers a portion of said hollow interior.

* * * * *